United States Patent [19]

Miniere

[11] 4,086,920

[45] May 2, 1978

[54] INTERMITTENT INFLATABLE APPARATUS

[76] Inventor: Jack K. Miniere, 685 Minnesota, Winter Park, Fla. 32789

[21] Appl. No.: 722,490

[22] Filed: Sep. 13, 1976

[51] Int. Cl.[2] ..... A61H 1/00

[52] U.S. Cl. ..... 128/24 R

[58] Field of Search ..... 128/24 R, 24.1, 40, 128/64, 297–300, 325

[56] References Cited

U.S. PATENT DOCUMENTS

| | | | |
|---|---|---|---|
| 2,781,041 | 2/1957 | Weinberg | 128/24 R |
| 3,101,085 | 8/1963 | Murphy | 128/325 |
| 3,167,067 | 1/1965 | Rand | 128/24 R |
| 3,465,749 | 9/1969 | Moreland et al. | 128/24 R |
| 3,896,794 | 7/1975 | McGrath | 128/24 R |

*Primary Examiner*—Lawrence W. Trapp

*Attorney, Agent, or Firm*—Duckworth, Hobby, Allen & Pettis

[57] ABSTRACT

A pneumatic apparatus for intermittently inflating and deflating one or more inflatable members with a fluid pump. A fluid coupler is located between the fluid pump and the inflatable members, which coupler intermittently reverses the direction of the flow to the inflatable members in a predetermined time sequence so as to direct a positive air pressure into the inflatable member followed by a negative air pressure.

14 Claims, 4 Drawing Figures

INTERMITTENT INFLATABLE APPARATUS

BACKGROUND OF THE INVENTION

The present invention relates to therapy devices and especially to an intermittent inflatable pneumatic apparatus for intermittently applying air pressure to a patient.

In the past, a great variety of extremity pumps and appliances have been provided in which an inflatable sleeve is slipped over an arm or a leg, and inflated to apply predetermined pressure to the arm or leg. Such devices are commonly used in the treatment of lymphedema of the extremities as well as in post-operative venous ligation and for providing the counteraction against the internal hydrostatic pressures of the tissues, lymphatic system and venous vessels.

The present invention, on the other hand, is directed towards an air therapy stimulator for use by a patient, especially in post-operative treatment of the lower limbs, to assist in the circulation to prevent embolisms in the leg and in preventive therapy for certain vascular weaknesses. The present invention is also directed towards an apparatus for providing massage therapy for persons who are on their feet for long periods of time. The present invention distinguishes over prior art in that it intermittently inflates inflatable sleeves or the like. It may be operated with a single sleeve or a plurality of sleeves. A rapid cycling time is obtained by a coupling system, which rapidly reverses the air pressure applied to the inflatable sleeves, applying a negative pressure to follow the positive pressure in the sleeve. The cycling time may easily be adjusted for different utilizations of the apparatus.

SUMMARY OF THE INVENTION

A pneumatic intermittently inflatable apparatus has a pneumatic pump coupled through a fluid coupler to one or more inflatable sleeves, or other members, which may be attached to a patient being treated. The fluid coupling is connected to the pneumatic pump with one input and one output air line and connected to the inflatable sleeve with a pair of input-output lines. The pneumatic coupling intermittently reverses the flow of air, so that one input line and one output line have positive pressures while the other input and output line have negative pressures, so that the air pump is blowing air through one line and receiving it through the other. The flow of air through the line is intermittently reversed in a predetermined time sequence which may be adjusted for different utilizations of the apparatus.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
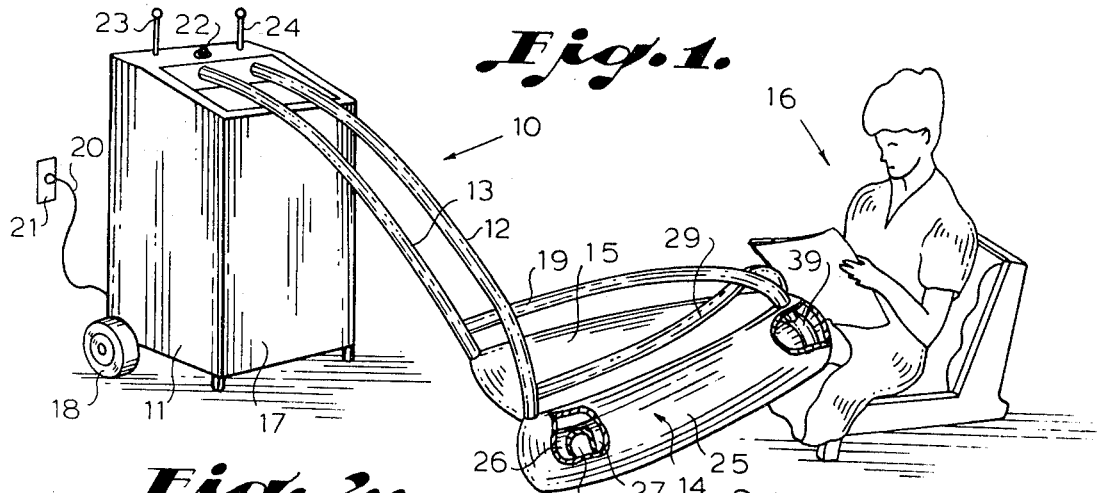
FIG. 1 is a perspective view of an intermittent inflatable system connected to the legs of a patient.

Referring now to FIG. 1 of the drawings, a pneumatic therapy stimulator 10 has a casing 11 for the pump unit, with a pair of hoses 12 and 13 connected to the pump unit 11 and to a pair of inflatable sleeves 14 and 15 placed over the legs of patient 16. The pump unit 11 has a casing 17 which may have wheels 18 and an electrical cord 20 extending therefrom for plugging into an electrical receptacle 21. The casing has an on-off button 22 along with a left-hand control 23 and a right-hand control 24. In operation, the pumping unit 11 would be turned on, and would inflate one sleeve 14 while deflating the sleeve 15, and then would reverse to deflate the inflatable sleeve 14 while inflating sleeve 15, thereby giving it alternate intermittent pressure application to the legs of the patient 16. The sleeves 14 and 15 have an outer portion 25 which may be rigid or flexible, but has a resilient inner side 26, thereby forming an air chamber 27 between the outer walls 25 and inner walls 26. And further, providing an open area 28 inside the inner wall 26 for the insertion of the patient's leg. Thus, the patient's leg can be slipped into the sleeve or cuff 14, and the application of air to the air chamber 27 will fill the chamber in expanding the inner wall 26 relative to the outer wall 25 thereby applying pressure to the patient's leg. It will, of course, be clear that different sized sleeves can be utilized for the patient's arms as desired and other shaped inflatable members can be attached to the chest or other portions of the patient's body without departing from the spirit and scope of the invention.

This embodiment has crossed hoses 19 and 29 with hose 19, connecting hose 13 to sleeve 25 annular inflatable portion 39 and hose 29 connecting hose 12 for a similar annular portion in sleeve 15. Inasmuch as the hoses 12 and 13 are alternating negative and positive pressures, the inflatable portions 39 will be inflated when the remainder of the sleeve is deflated due to the cross connection. This seals the leg in the sleeve 15 or 25 and if sleeves 15 or 25 are rigid, a negative pressure can be applied to the patient's legs. In the main embodiment, however, hoses 19 and 29 and sleeves 39 are eliminated since the negative pressure is not needed.

Figure 2:
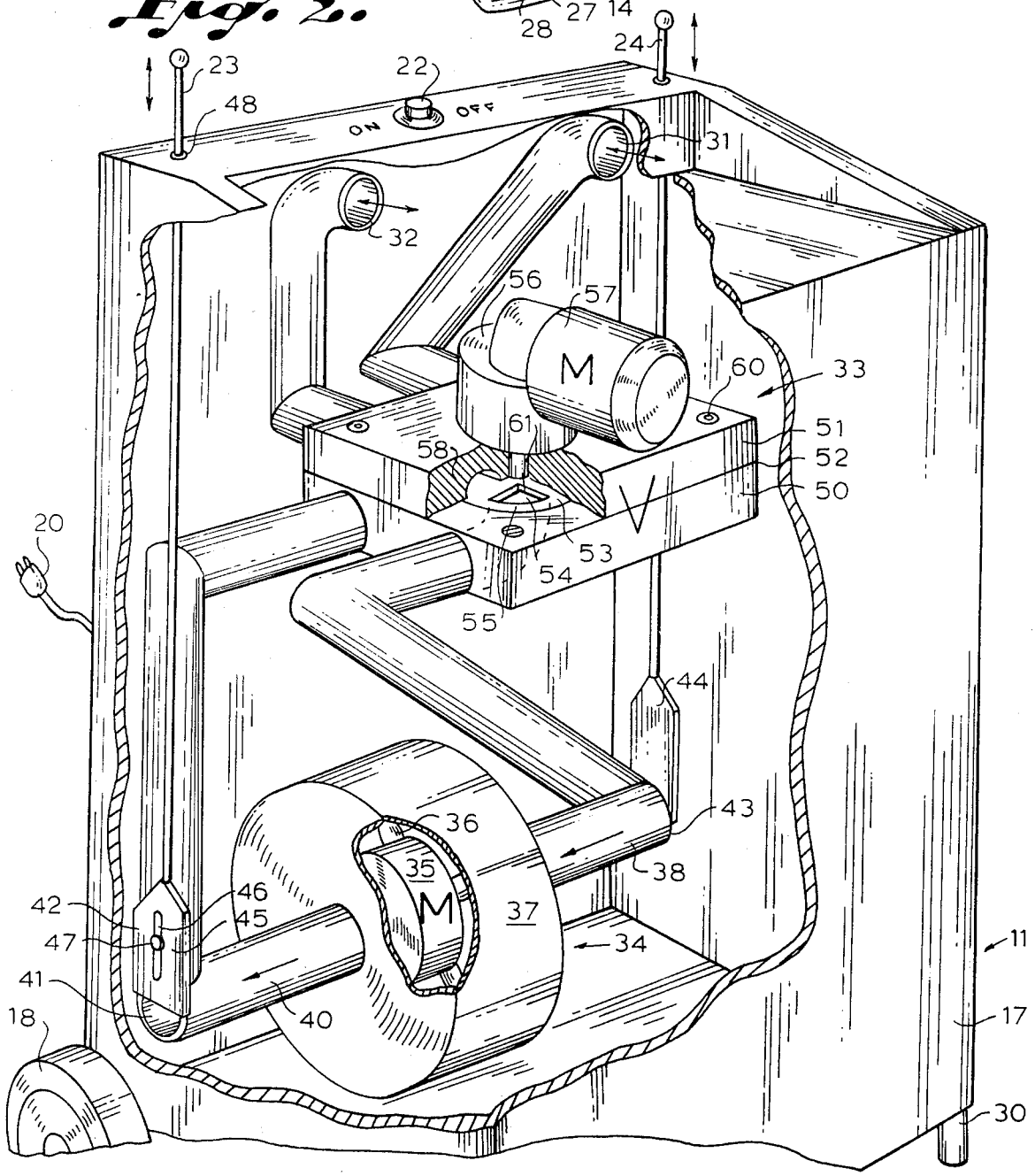
FIG. 2 is a cut-away perspective view of the pneumatic pump and pneumatic coupling system of the present invention.

Turning now to FIG. 2, the operation of the pneumatic pumping unit 11 is illustrated having the outer casing 17 and the wheels 18 along with a pair of floor supports 30. The electrical cord 20 is illustrated along with the on-off button 22 left-hand control 23 and right-hand control 24. The tubes 12 and 13 of FIG. 1 are connected to output pipes 31 and 32, respectively, which in turn are connected to a fluid coupling 33. A pneumatic or fluid pump 34, a main electrical motor 35, and a blower 36 are placed in a blower casing 37. The fluid pump 34 has connecting pipes for hoses 38 and 40 connecting either side of the air pump 34 to the coupling 33. An opening 41 in the pipe 40 is closed by the valve 42 actuated by the control 23 which may be partially or fully opened as desired. A similar opening 43 in the pipe 38 controls valve 44 actuated by the control 24. The valves 42 and 44 may be simple, flat valve elements having a slot 46 and a pin 47 holding it to the pipes 40, and thereby allowing it to slide over the opening 41, responsive to the sliding of a control 23 in the opening 48. These valves allow the pressure to the system to be varied.

Figure 3:
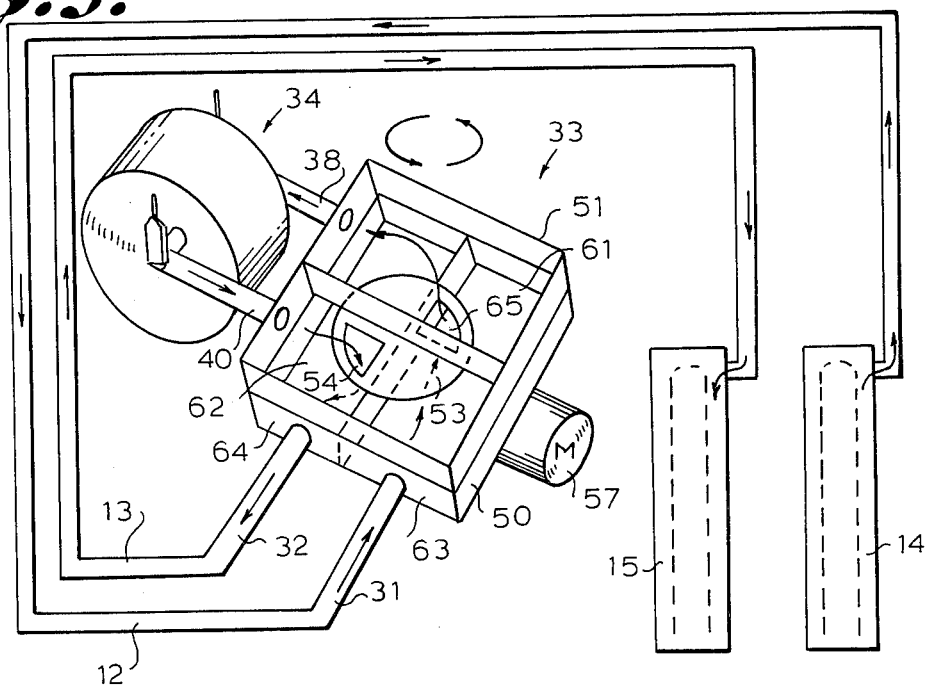
FIG. 3 is a diagramatic view of the operation of the pneumatic coupler in one position.

The fluid coupler 33 has a bottom portion 50, a top portion 51 with a dividing plate 52, and has pipes 38 and 40 connected to the top portion 51. The coupler has a rotating disc valve element 53 having a pair of pie shaped openings 54, passing therethrough, and is placed in a circular opening 55 in the dividing member 52. It will, of course, be clear that other shaped valve elements 53 and openings 54 can be utilized without departing from the scope of the invention. The valve element 53 has a shaft fixedly attached thereto, and extending into a gearbox 56, which is driven by an electrical motor 57. The motor rotates the valve element 53 at a predetermined rate of rotation, which can be adjusted by varying the speed of the motor or the gearbox 56. The rotation speed is at a slow rotation such as 6 or 8 rotations per minute. The top portion 51 of the coupler 33 forms a pair of interior chambers divided by a divider 58, and the entire coupling may be bolted with bolts 60 to hold the bottom portion 50, the dividing portion 52, and the top portion 51 together. The output hoses 31 and 32 are connected to the bottom portion 50 of the fluid coupler 33, which forms a pair of identical chambers to the top portion 51, except that an equivalent divider 61, a small portion of which may be seen in this view, divides the bottom pair of chambers perpendicular to the top chambers. That is, dividing member 61 runs exactly perpendicular to dividing member 58. Thus the openings 54 and the valve element 53 can connect either top chamber to either bottom chamber depending upon the position during rotation, and a similar opening 54 opposite therefrom, would simultaneously connect different chambers to each other. This allows the positive air pressure to be applied through pipe 40 to either one of the chambers in the upper portion 51 of the fluid coupler 33 through the opening 54 and out either the openings 32 or 31 while the opposite hose 31 or 32 is drawing air back into the air pump 34. By the rotation of the valve element 53, the air flow between the output pipes 31 and 32 is then reversed so that the hose drawing air then starts driving air with a positive air pressure while the opposite hose goes from a positive to a negative pressure. This is more clearly illustrated in the diagramatic drawings of FIG. 3 and 4, in which the air pump 34 has an input line 38 and an output line 40, so that the line 38 is always drawing air into the air pump while the line 40 is always directing air from the air pump into the coupler 33. In FIG. 3, the upper portion 51 of the air coupler can be seen as having a pair of chambers 61 and 62 while the lower portion 50 has a pair of chambers 63 and 64. The valve element 53 has an opening 54 and a second opening 65, so that in the position shown in FIG. 3, opening 65 connects chambers 61 and 63, thereby connecting line 38 through the fluid coupler 33 to line 31, while the opening 54 connects chamber 62 with chamber 64, thereby connecting line 40 through the coupler 33 to line 32.

Figure 4:
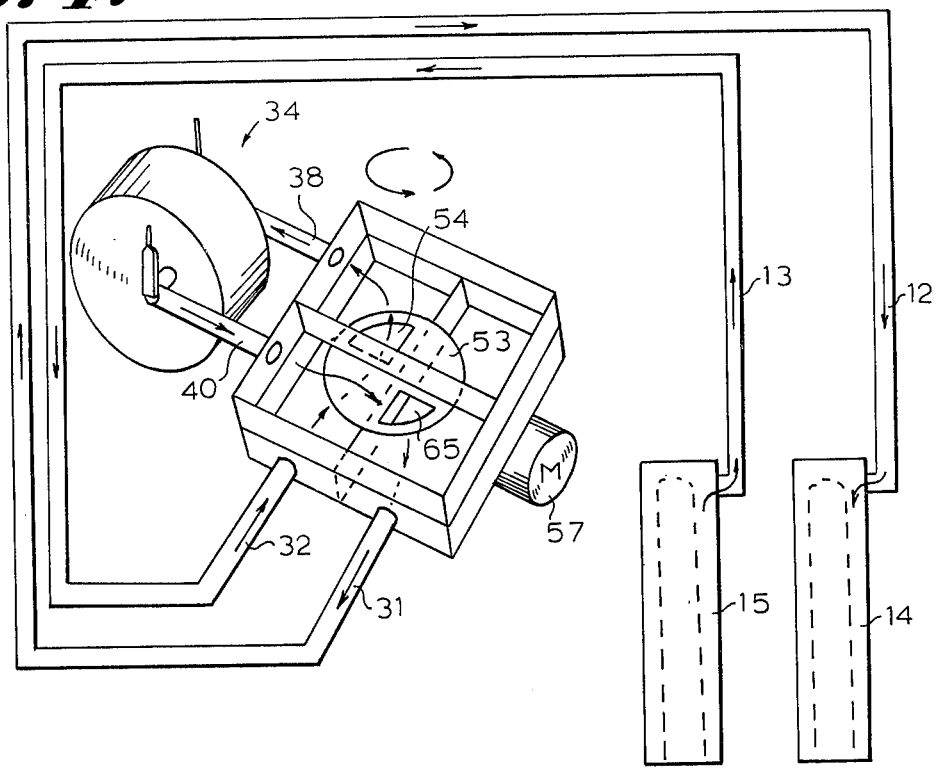
FIG. 4 is a diagramatic view of a pneumatic coupler in a second position.

In FIG. 4, the position of the valve element 53 has been shifted so that the opening 54 connects line 38 to line 32, and opening 65 connects line 40 to line 31, thereby reversing the flow from that illustrated in FIG. 3. That is, when the valve element 53 is rotated by the electric motor 57, the position of the openings 54 and 65 will continuously change in a predetermined pattern according to the rotation of the valve element 53, thereby continuously reversing the flow of direction of air in the pipes 31 and 32. These views also illustrate the connection of the pipes 31 to hose 12, and 32 to hose 13, and the connection of the hoses 12 and 13 to the inflatable sleeves 14 and 15. The coupler 33 thus allows not only the application of fluid pressure to the inflatable sleeves 14 and 15, and the release of the pressure, but applies first a positive pressure and then a negative pressure applying air to the sleeve, and then withdrawing the air. Thus, while one sleeve 14 or 15 is being expanded, the air is being drawn from the other sleeve; and upon reversing, the air is drawn from the one and applied to the other.

The controls 23 or 24 can be actuated in degrees thereby varying the pressure to the coupler 33 and to the sleeves 14 and 15. Completely opening of one valve will exhaust the air to the atmosphere and provide no pressure to the sleeves 14 and 15. Either sleeve 14 or 15 can be operated independent of the other as desired.

It should be clear at this point that a pneumatic therapy system has been provided in which intermittent and alternate air pressure can be applied to inflatable sleeves responsive to the operation of a fluid coupler. However, it should also be clear that other embodiments are contemplated as being within the scope of the invention, such as the use of single or double inflatable members which can be attached to the chest or other portions of the body. Accordingly, the present invention is not to be construed as limited to the particular forms disclosed herein, which are to be regarded as illustrative rather than restrictive.

I claim:

1. An intermittent inflatable apparatus comprising in combination:

a fluid pump;

at least one inflatable member attached to a patient and being intermittently inflatable;

coupling means coupling said fluid pump to each said inflatable member whereby pressurized fluid is directed to each inflatable member, said coupling means having a first pair of chambers and a second pair of chambers separated by a variable valve member, said variable valve member having a plurality of openings therethrough at predetermined locations, thereby operatively connecting at least one first chamber and one second chamber; and coupling means drive means operatively connected to said coupling means for driving said coupling means variable valve member between positions whereby at least one said inflatable member may be intermittently inflated.

2. The apparatus in accordance with claim 1, in which the plurality of openings in said variable valve member are located to couple each first chamber with one second chamber.

3. The apparatus in accordance with claim 2, in which said fluid pump is a pneumatic pump.

4. The apparatus in accordance with claim 3, in which said pneumatic pump has an input connected to one first chamber of said coupling means and an output connected to a second first chamber of said coupling means.

5. The apparatus in accordance with claim 4, in which one inflatable member is coupled to one second chamber.

6. The apparatus in accordance with claim 5, in which a second inflatable member is connected to a second chamber.

7. The apparatus in accordance with claim 6, in which said coupling means drive means is a motor connected to said variable valve member of said coupling means for rotation of said valve member for alternately connecting different first and second chambers at each opening through said valve element during rotation of said valve member.

8. The apparatus in accordance with claim 7, in which said motor coupling means drive means electrical motor is connected to said valve elements through a gear drive.

9. The apparatus in accordance with claim 6, in which said first and second inflatable members are flexible sleeves adapted to fit over the limb of a patient.

10. The apparatus in accordance with claim 1, in which said fluid pump input has a valve for opening and closing said input to the surrounding air.

11. The apparatus in accordance with claim 1, in which said fluid pump output line has a valve attached thereto for opening and closing said output valve to the surrounding air.

12. The apparatus in accordance with claim 1, in which both said input and output lines each have valves attached thereto for opening and closing said input and output lines to the surrounding air.

13. The apparatus in accordance with claim 3, in which said fluid pump is an air blower, connected by hoses to said coupling means.

14. The apparatus in accordance with claim 13, in which said fluid pump coupling means is mounted in a portable casing having at least two wheels attached thereto.

* * * * *